US008598444B2

(12) United States Patent
Morrissey et al.

(10) Patent No.: US 8,598,444 B2
(45) Date of Patent: Dec. 3, 2013

(54) MUSIC-ORIENTED CONTROLLER FOR A TABLET COMPUTING DEVICE

(75) Inventors: Daniel R. Morrissey, Foster, RI (US); John A. Souppa, Ashland, MA (US)

(73) Assignee: inMusic Brands, Inc., Cumberland, RI (US)

( * ) Notice: Subject to any disclaimer, the term of this patent is extended or adjusted under 35 U.S.C. 154(b) by 67 days.

(21) Appl. No.: 13/313,768

(22) Filed: Dec. 7, 2011

(65) Prior Publication Data

US 2012/0144977 A1 Jun. 14, 2012

Related U.S. Application Data

(60) Provisional application No. 61/421,249, filed on Dec. 9, 2010.

(51) Int. Cl.
*G10H 1/32* (2006.01)
*G10H 3/00* (2006.01)

(52) U.S. Cl.
USPC ..... 84/743

(58) Field of Classification Search
USPC ..... 84/743
See application file for complete search history.

(56) References Cited

U.S. PATENT DOCUMENTS

| | | | | |
|---|---|---|---|---|
| 8,093,486 | B2 * | 1/2012 | Behringer et al. | 84/615 |
| 2010/0064883 | A1 * | 3/2010 | Gynes | 84/645 |
| 2011/0088535 | A1 * | 4/2011 | Zarimis | 84/645 |
| 2012/0125180 | A1 * | 5/2012 | Shim | 84/666 |
| 2012/0204704 | A1 * | 8/2012 | Shim et al. | 84/645 |
| 2012/0297962 | A1 * | 11/2012 | O'Donnell et al. | 84/645 |
| 2012/0318121 | A1 * | 12/2012 | Mittelstadt et al. | 84/743 |
| 2013/0068086 | A1 * | 3/2013 | Mittelstadt et al. | 84/645 |

OTHER PUBLICATIONS

Kirn, Peter "Akai Turns an iPad Into a Full-Sized Music Keyboard: Akai SynthStation49" Jan. 12, 2011 [online]. Retrieved from: http://createdigitalmusic.com/2011/01/akai-turns-an-ipad-into-a-full-sized-music-keyboard-akai-synthstation49 (1 page).*

Kirn, Peter "Ion Makes a Music Keyboard Dock for the iPhone; Would You Want One?" Jan. 9, 2010 [online]. Retrieved from: .http://createdigitalmusic.com/2010/01/ion-makes-a-music-keyboard-dock-for-the-iphone-would-you-want-one (1 page).*

* cited by examiner

*Primary Examiner* — Jeffrey Donels
(74) *Attorney, Agent, or Firm* — Finnegan, Henderson, Farabow, Garrett & Dunner, LLP

(57) ABSTRACT

A controller for a tablet computing device is disclosed. The controller has a body having a number of control surfaces. A dock is on the body and has an L-shaped groove configured and arranged to receive a tablet computing device docked therein. A microcontroller is configured and arranged to detect interactions with the control surfaces and transmit the interactions to the tablet computing device. An analog output is configured and arranged to receive audio signals from the tablet computing device whereby interactions from the control surfaces are processed by the tablet computing device into audio signals for transmission through the audio output.

5 Claims, 9 Drawing Sheets

MUSIC-ORIENTED CONTROLLER FOR A TABLET COMPUTING DEVICE

CROSS-REFERENCE TO RELATED APPLICATION

The present patent document claims priority to earlier filed U.S. Provisional Patent Application Ser. No. 61/421,249, filed on Dec. 9, 2010, the entire contents of which are incorporated herein by reference.

BACKGROUND OF THE INVENTION

1. Field of the Invention

The present patent document relates generally to tablet computing devices and more particularly to a music-oriented controller for a tablet computing device.

2. Background of the Related Art

Tablet computing devices, such as the iPad brand tablet computing device manufactured by Apple, Inc., are becoming popular platforms for music creation applications. These music creation applications may include on-screen keyboards for playing piano and synthesizer-type sounds, and on-screen drums for playing drum sounds, among other instruments.

However, these applications lack both an ergonomic and a music-oriented way for users to enter note and controller data so that users can record or perform their music.

Referring to FIGS. 1 and 2, screenshots of two prior art keyboard applications are shown running on a tablet computing device. However, even with a 10" screen common to many tablet computing devices, the applications have a control surface that is a small, which makes it difficult to perform many types of music. In the keyboard example, the keys are tiny and virtually unplayable without striking unintended keys. Although the keys may be made larger, which enables more accurate striking of the keys, there are now so few keys that the range of melodies and chords that can be played is extremely limited.

In addition to the limited size of the control surfaces, the control surfaces also suffer from the disadvantage of lacking velocity sensitivity (i.e. tapping softly and hard produces the same volume of sound). This disadvantage affects drum simulators as well as keyboard simulators.

Therefore, there is a perceived need in the industry for a device that enables a user to comfortably and conveniently enter note and controller data to a tablet computing device. There is also a perceived need for a device that enables a tablet computing device to detect velocity of strikes against a control surface.

SUMMARY OF THE INVENTION

The present invention solves the problems of the prior art by providing a device having a control surface including a tilt-able dock connection for a tablet computing devices that further is configured and arranged for direct communication with a program application running on the tablet computing device.

Accordingly, among the objects of the present invention is the provision for a more ergonomic, playable, and musically inspiring control surface for a tablet computing device, such as an iPad brand tablet computing device.

Another object of the present invention is the provision for a control surface that can interface and communicate with a music program application running on a tablet computing device.

Another object of the present invention is the provision for a control surface that includes physical wheels, sliders, knobs, piano style keys, drum pads, touch strips, joy sticks, and XY-axis pads.

Another object of the present invention is the provision for a control surface that includes larger controls that are more easily manipulated than the control surface of a tablet computing device.

Another object of the present invention is the provision for a greater number of controls and control inputs than the tablet computing device contains.

Another object of the present invention is the provision for a control surface that includes velocity sensitivity.

Yet, another object of the present invention is the provision for a control surface that permits tactile response.

Yet, another object of the present invention is the provision for a control surface that detects differences in pressure.

Another provision of the present invention is the provision for a standard output methods for the professional musician, such as professional I/O jacks, XLR jacks, ¼" jacks, and RCA jacks.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
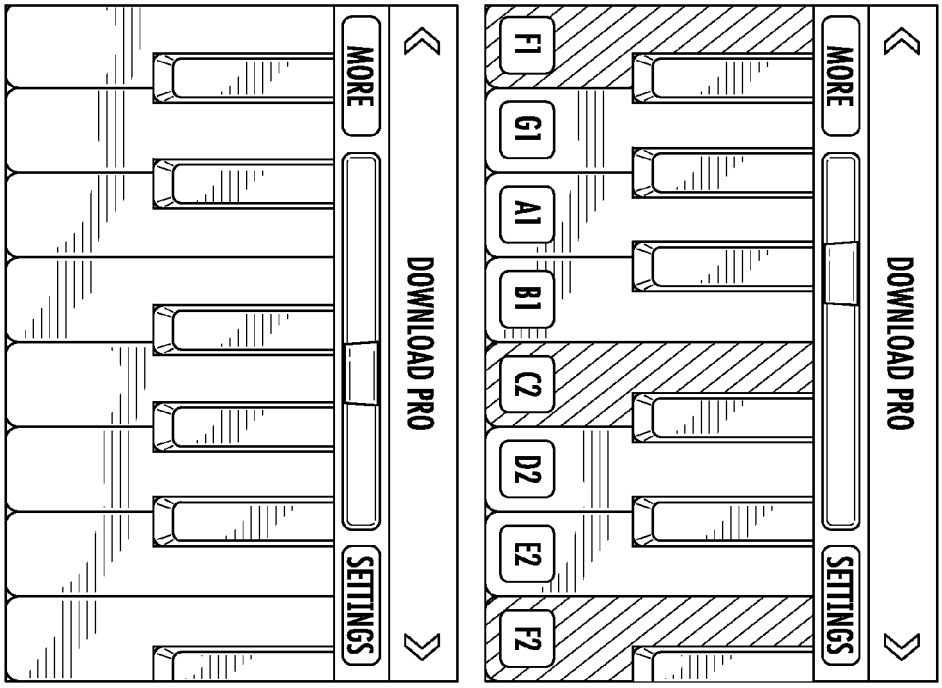
FIG. 1 PRIOR ART
FIG. 1 is a prior art view of a tablet computing device with a keyboard application running thereon with a magnified view of the keys of the keyboard.
Figure 2:
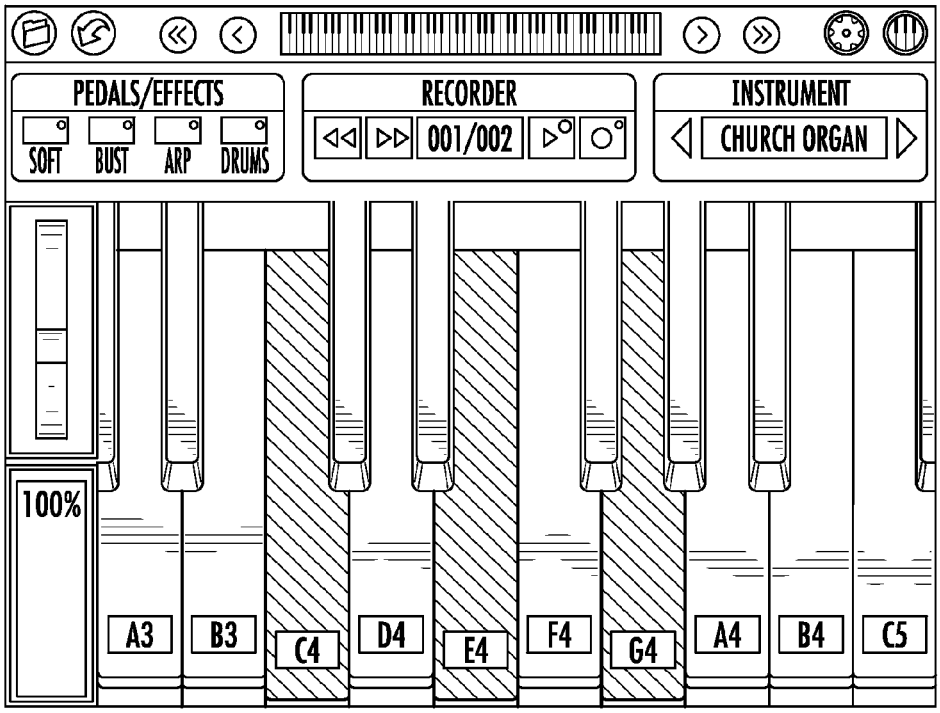
FIG. 2 PRIOR ART
FIG. 2 is a prior art view of a tablet computing device with another keyboard application running thereon with a magnified view of the keys of the keyboard.
Figure 3:
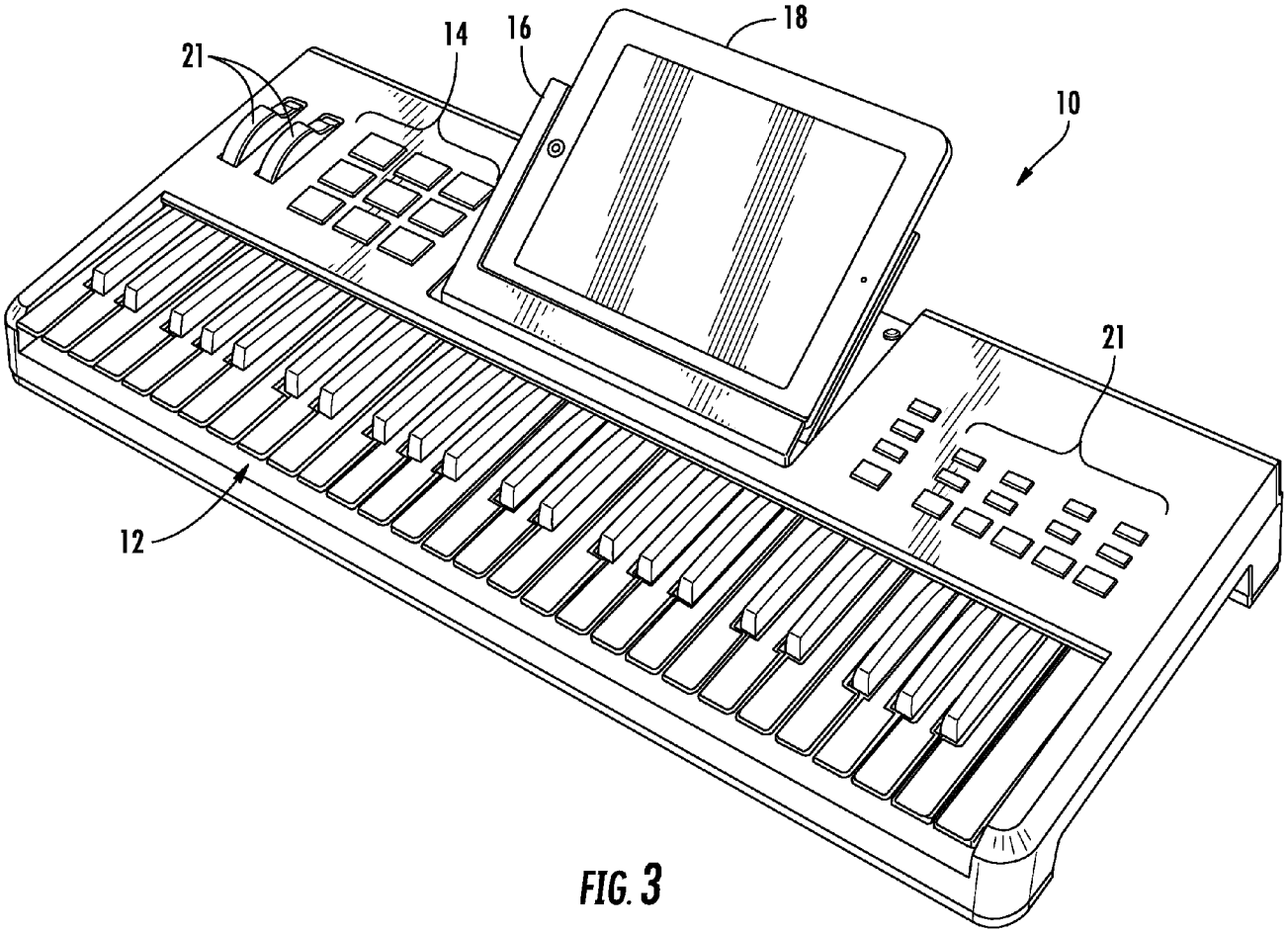
FIG. 3 is a top, front perspective view of an embodiment of the music-oriented controller of the present invention with a tablet computing device docked therein.
Figure 4:
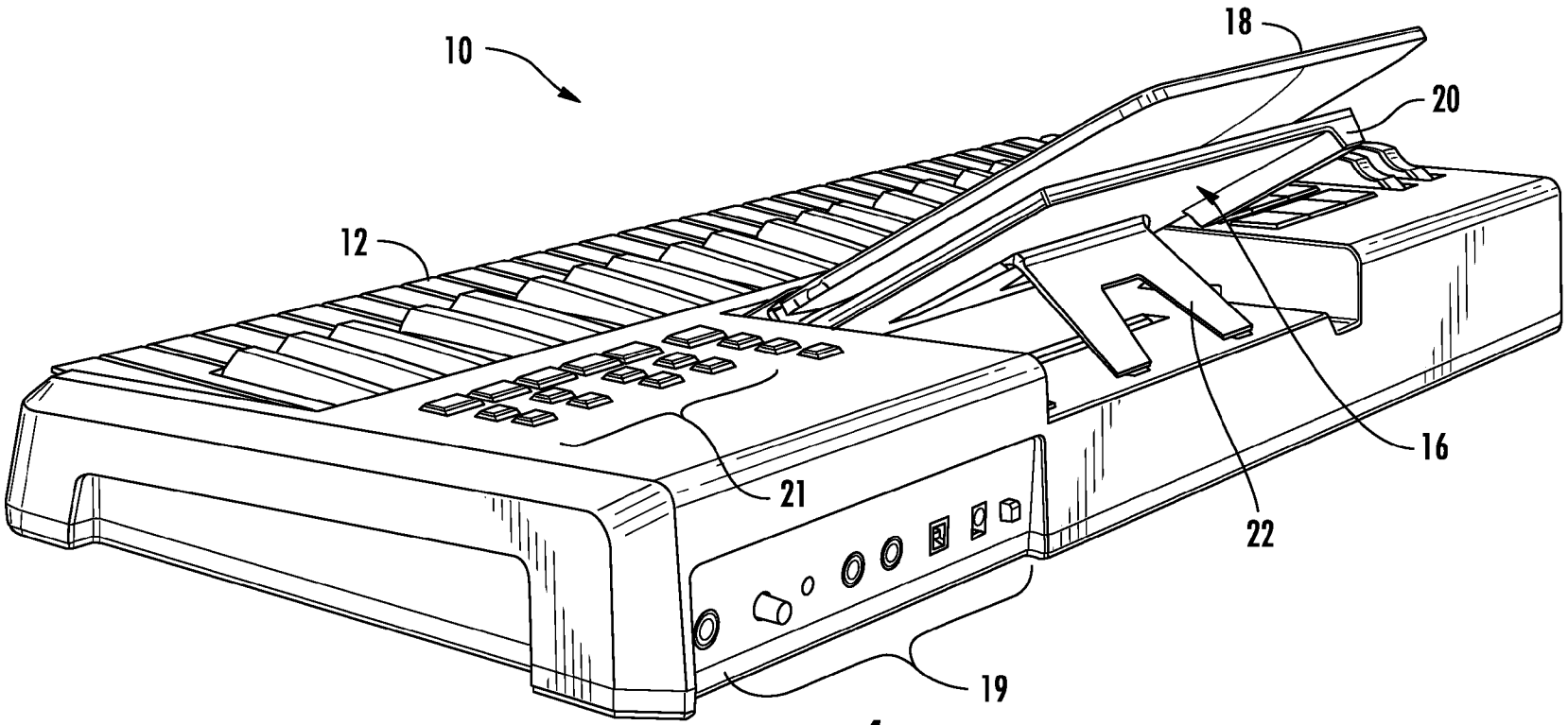
FIG. 4 is a top right side, rear perspective view of an embodiment of the music-oriented controller of the present invention with a tablet computing device docked therein.
Figure 5:
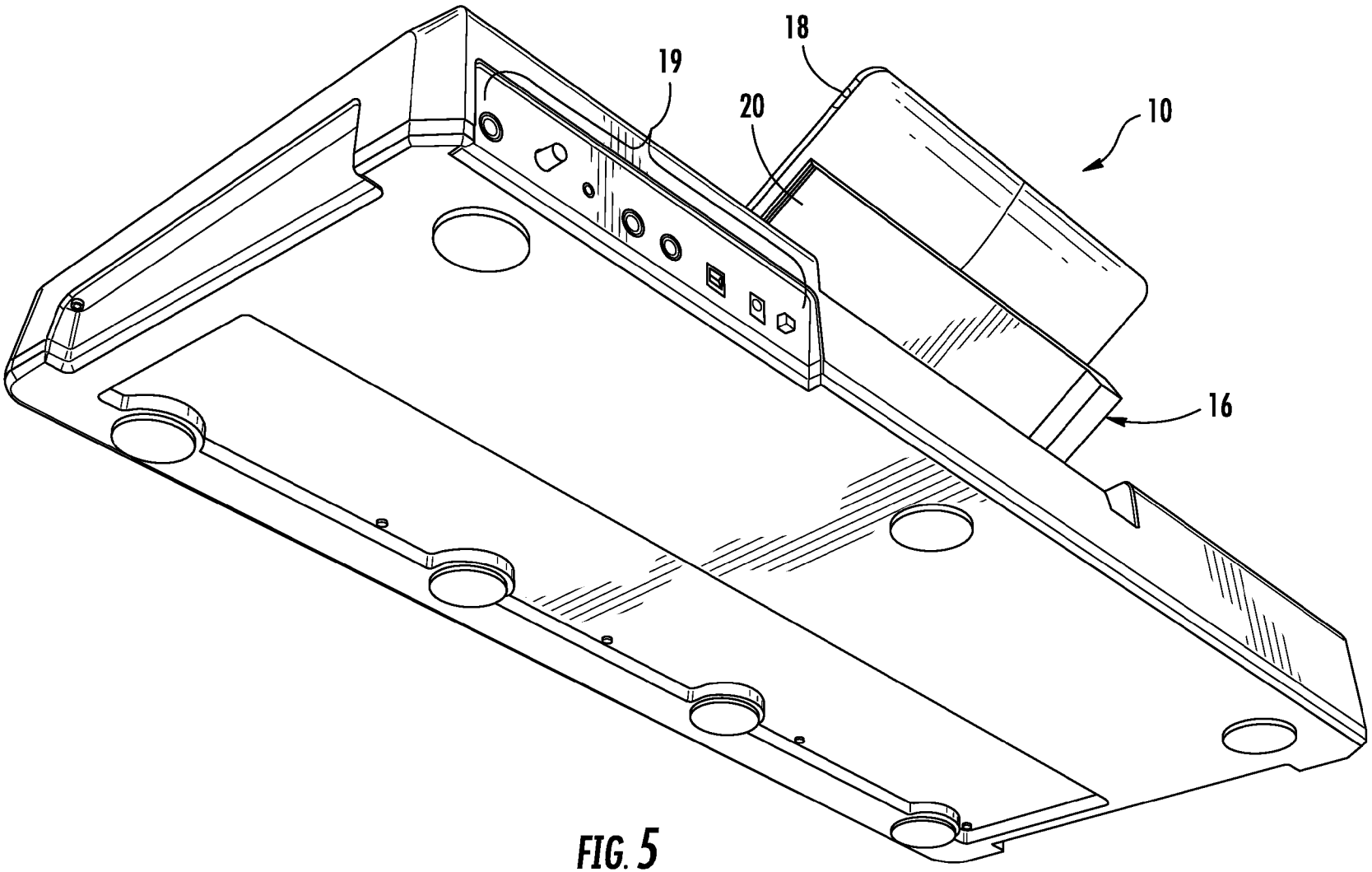
FIG. 5 is a bottom right side, rear perspective view of an embodiment of the music-oriented controller of the present invention with a tablet computing device docked therein.
Figure 6:
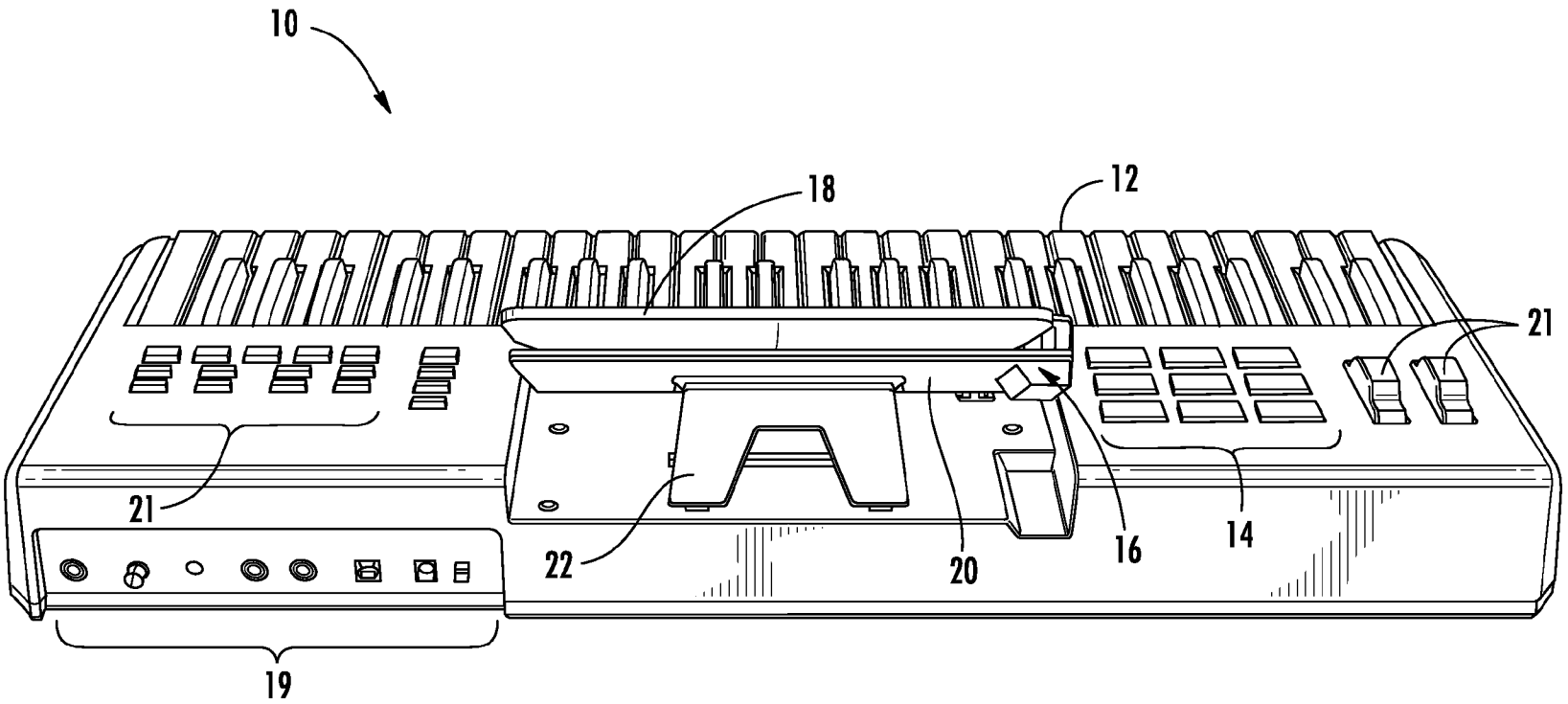
FIG. 6 is another top, rear perspective view of an embodiment of the music-oriented controller of the present invention with a tablet computing device docked therein.
Figure 7:
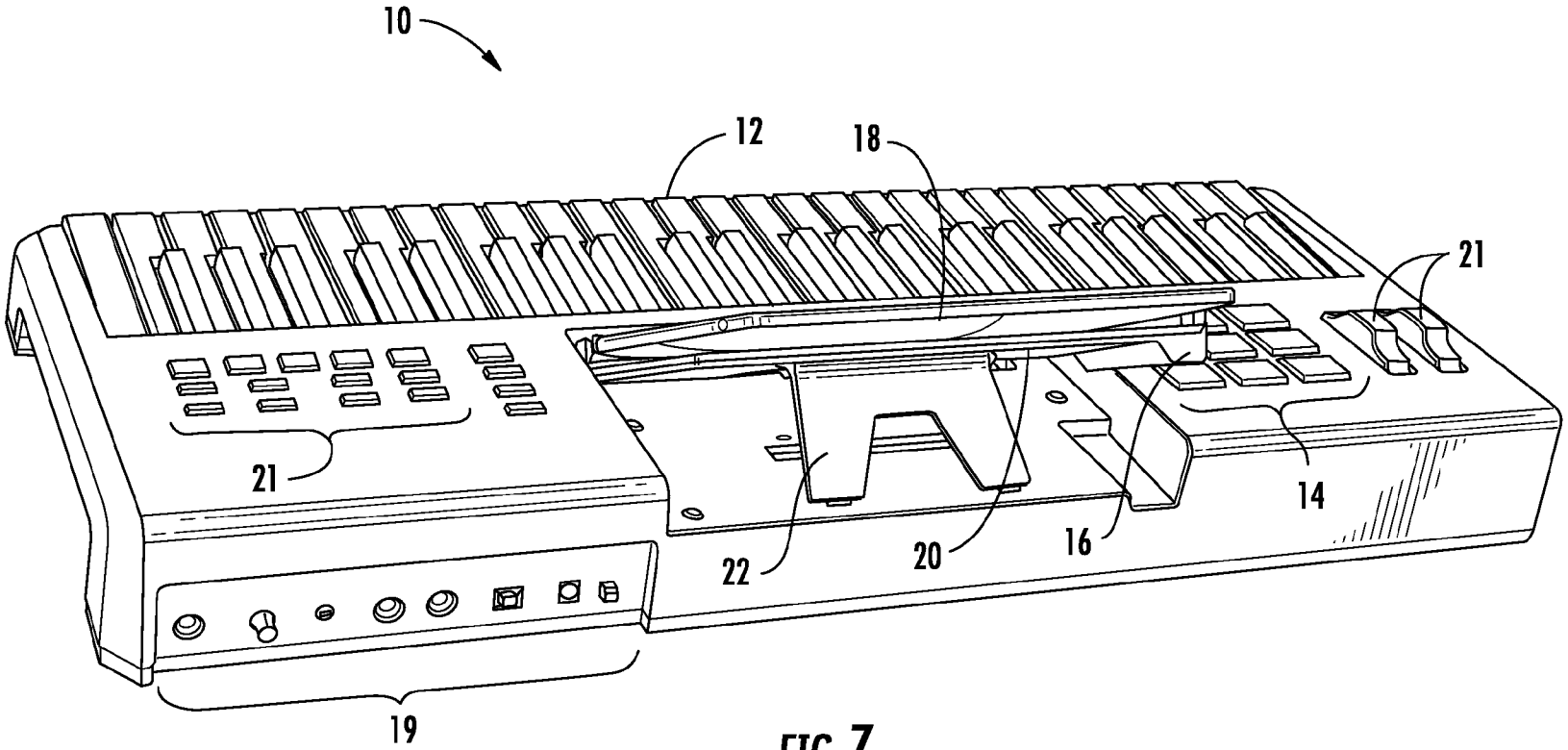
FIG. 7 is another top, rear perspective view, at a slight angle to the right side, of an embodiment of the music-oriented controller of the present invention with a tablet computing device docked therein.
Figure 8:
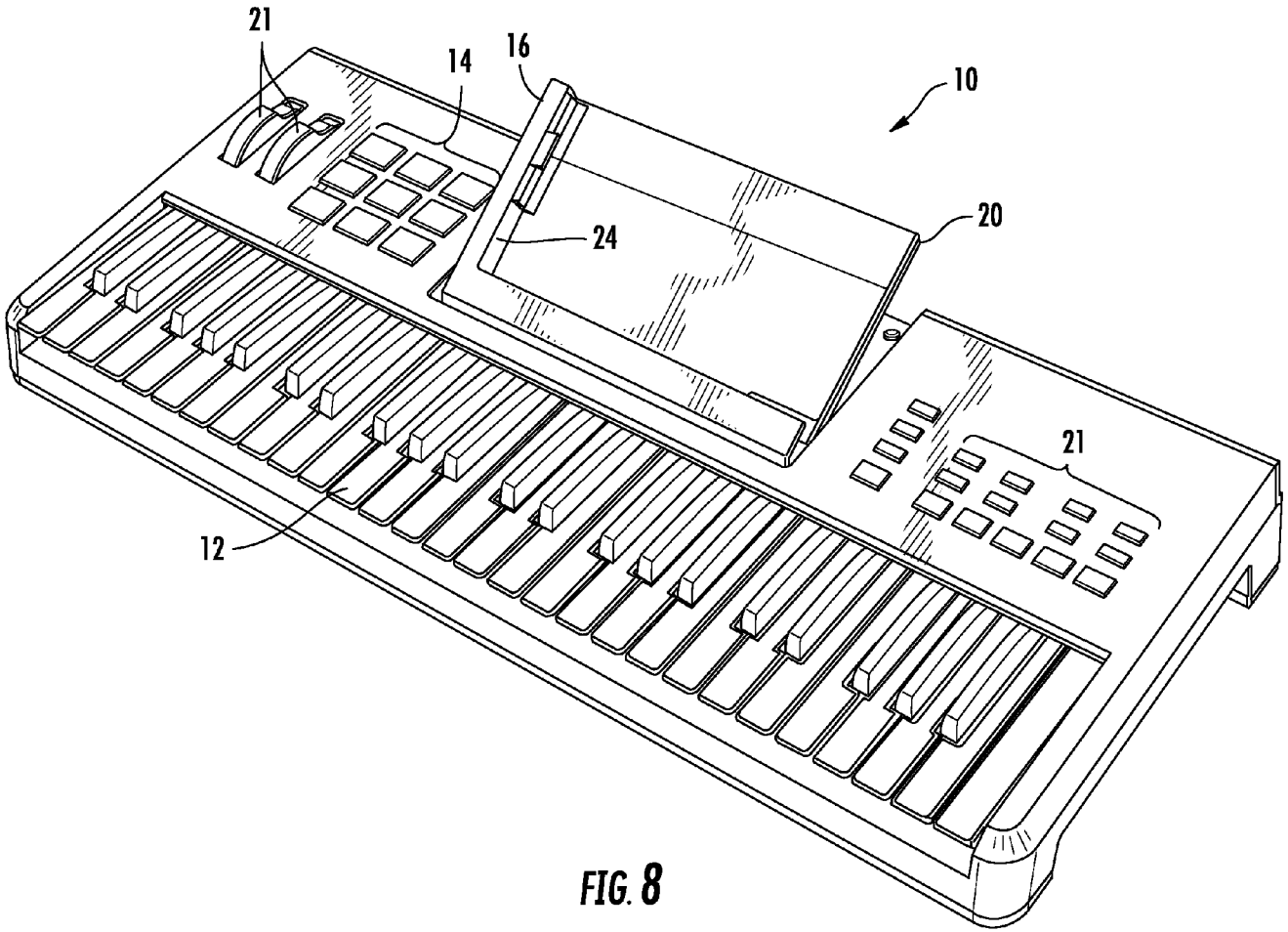
FIG. 8 is a top, front perspective view of an embodiment of the music-oriented controller of the present invention with the dock empty.

Referring now to FIGS. 3-8, an embodiment of the music-oriented controller of the present invention is shown generally at 10. The controller includes a number of velocity sensitive control surfaces. In particular, keyboard keys 12 and drum pads 14 may be included. The controller 10 also includes a dock 16 configured to permit a tablet computing device 18 to interface therein. As can be appreciated, the use of velocity sensitive control surfaces allows the controller 10 to detect the force with which the control surfaces are struck, thus allowing the controller 10 to send appropriate note and controller data to the tablet computing device 18. Also the controller 10 may include various analog audio controls such as volume, equalizers and special effects 21.

In addition to various analog audio controls 21, the controller 10 may further include a number of alphanumeric keys. The alphanumeric keys may be further arranged in a "QWERTY" keyboard arrangement.

The controller 10 may include control surfaces 30 such as sliders. In addition to sliders, the controller 10 may include level meters, transport controls for the tablet computing device 18, a jog wheel and various analog audio controls 21, such as volume, equalizers and other special effects. The controller may include I/O jacks 19 such as professional I/O jacks, XLR jacks, ¼" jacks, and RCA jacks.

The tablet computing device 18 is connected to the controller 10 via a dock 16. The dock 16 includes a portion 20 that may be tilted to a desired viewing angle and propped up to that position with a hinged stand 22. The tilt-able portion 20 includes an L-shaped groove 24 sized and dimensioned to receive the tablet computing device 18 therein and hold it securely against the tilt-able portion 20 of the dock 16. The tablet computing device 18 is electronically connected to the controller 10 of the present invention via a serial interface described further below. The serial interface may be integrated with the dock 16 or be configured as a separate cord connectable to the tablet computing device 18.

Figure 9:
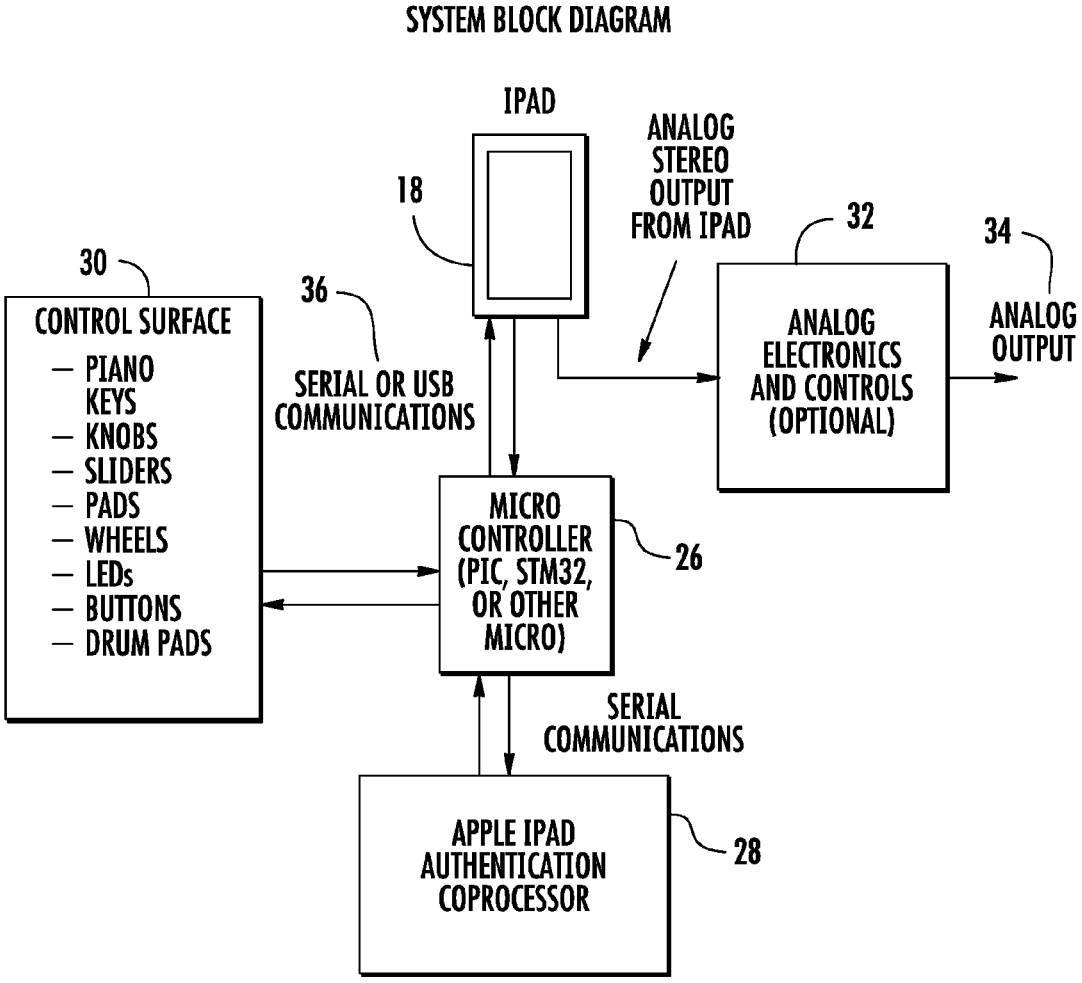
FIG. 9 is a block diagram of an embodiment of an electrical circuit for a music-oriented controller of the present invention.

Referring now to FIG. 9, a block diagram of an electronic circuit for the controller is shown. The circuit includes a microcontroller 26. The microcontroller 26 communicates with the tablet computing device 18 via a serial interface (such as USB) 36. In the instance where the tablet computing device 18 is an Apple brand iPod or iPhone brand device, the microcontroller 26 also communicates serially with an authentication chip 28, which is necessary to enable recording and other functions in Apple brand devices.

The microcontroller 26 also detects and interprets musician interaction with the velocity sensitive control surfaces and other control surfaces 30. For instance, the microcontroller 26 performs key and control scanning to detect button presses, key presses, drum pad hits, knob turns, and the like. The microcontroller 26 interprets these actions and sends the appropriate command to the tablet computing device 18 via the serial interface 36. As can be appreciated, the use of velocity sensitive control surfaces enable the microcontroller 26 to send note data that includes the force with which the control surface was struck, thus providing a greater range of recordable music.

The tablet computing device 18 may also send commands back to the microcontroller 26. For example, the tablet computing device 18 could send a command to light up an LED on the controller 10.

Because the tablet computing device 18 has analog inputs and outputs for music, these can be utilized for recording and playback. The controller 10 may also include additional analog circuitry for gain, equalizer and other functions 32, as well as professional industry-standard audio jacks.

Audio from the tablet computing device 18 may be routed through additional analog electronics and controls 32 and sent through an analog output 34.

Figure 10:
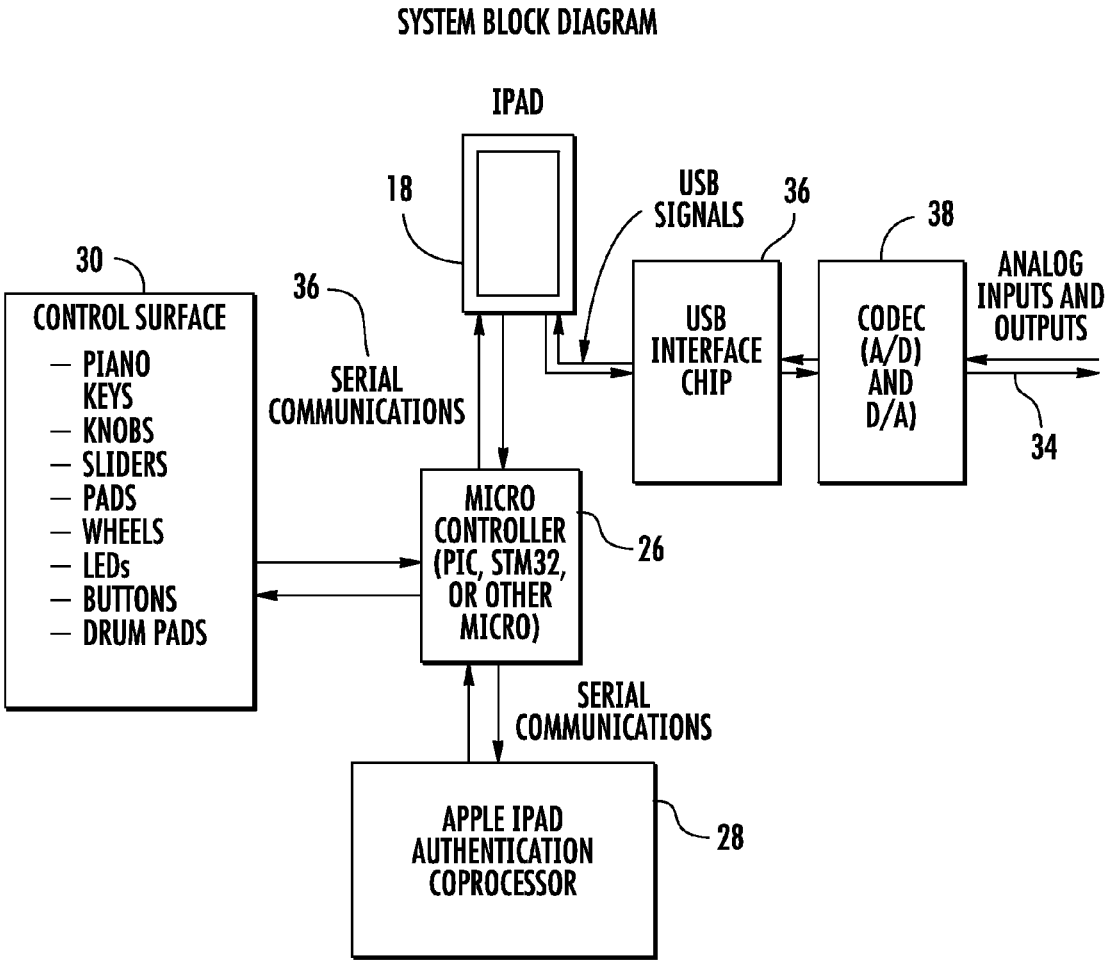
FIG. 10 is a block diagram of an alternative embodiment of an electrical circuit for a music-oriented controller of the present invention.

Referring now to FIG. 10, a block diagram of another embodiment of the electronic circuit of the controller 10. In this embodiment, the serial interface 36 is used to transmit the audio output from the tablet computing device 18 in digital format to the controller 10. Audio received via the serial interface 36 is converted from digital format to analog audio by an analog-to-digital converter 38 and routed out the analog audio outputs 34 of the controller 10.

Therefore, it can be seen that the present invention provides a unique solution to the problem of providing a music-oriented controller for a tablet computing device that includes larger, velocity sensitive keys and various other music controls that are desired by musicians.

It would be appreciated by those skilled in the art that various changes and modifications can be made to the illustrated embodiments without departing from the spirit of the present invention. All such modifications and changes are intended to be within the scope of the present invention.

What is claimed is:

1. A controller for a tablet computing device, comprising:

a body having a plurality of control surfaces;

a tiltable dock on the body having an L-shaped groove configured and arranged to receive the tablet computing device docked therein;

a hinged stand connected to said tiltable dock configured and arranged to prop said tiltable dock upwards to a fixed position;

a microcontroller configured and arranged to detect interactions with the plurality of control surfaces and transmit the interactions to the tablet computing device; and an analog output configured and arranged to receive audio signals from the tablet computing device;

whereby interactions from the plurality of control surfaces are processed by the tablet computing device into audio signals for transmission through the analog output.

2. The controller of claim 1, wherein the plurality of control surfaces are velocity sensitive.

3. The controller of claim 1, wherein the plurality of control surfaces further comprise drum pads.

4. The controller of claim 1, wherein the plurality of control surfaces further comprise piano keyboard keys.

5. The controller of claim 1, wherein the plurality of control surfaces are selected from the group consisting essentially of: comprising piano keys, knobs, sliders, pads, wheels, LEDs, buttons and drum pads.

* * * * *